United States Patent [19]

Collier

[11] Patent Number: 4,741,393

[45] Date of Patent: May 3, 1988

[54] HEAT EXCHANGER WITH COATED FINS

[75] Inventor: Howard I. J. Collier, Westlake, Ohio

[73] Assignee: JW Aluminum Company, Mt. Holly, S.C.

[21] Appl. No.: 77,251

[22] Filed: Jul. 24, 1987

[51] Int. Cl.[4] ..... F28F 13/18; F28F 19/02

[52] U.S. Cl. ..... 165/133; 165/134.1

[58] Field of Search ..... 165/133, 134.1; 62/272; 428/66, 461, 463

[56] References Cited

U.S. PATENT DOCUMENTS

| | | | |
|---|---|---|---|
| 778,320 | 12/1904 | Loyal . | |
| 2,007,000 | 1/1931 | Oakey | 29/157.3 |
| 2,152,331 | 3/1939 | Shoemaker | 165/133 X |
| 2,977,918 | 7/1957 | Kritzer | 113/118 |
| 2,994,123 | 6/1956 | Kritzer | 29/157.3 |
| 3,598,180 | 8/1971 | Moore, Jr. | 165/133 |
| 4,182,412 | 1/1980 | Shum | 165/133 |
| 4,325,220 | 4/1982 | McFarlin | 165/133 X |
| 4,480,684 | 11/1984 | Onishi et al. | 165/133 X |
| 4,588,025 | 5/1986 | Imai et al. | 165/133 |

*Primary Examiner*—Albert W. Davis, Jr.
*Assistant Examiner*—Richard R. Cole
*Attorney, Agent, or Firm*—James W. Grace; Charles W. Vanecek

[57] ABSTRACT

This invention relates to a heat exchanger with coated fins which dissipate heat from a tubular fluid transporting system. The fins have an uncoated, longitudinal central area and stripes of an anti-corrosion coating material along the outer edge areas.

6 Claims, 1 Drawing Sheet

HEAT EXCHANGER WITH COATED FINS

BACKGROUND OF THE INVENTION

1. Field of the Invention

This invention relates to a heat exchanger with coated fins which dissipate heat from a tubular fluid transporting system.

2. Description of the Prior Art

The use of fins attached to fluid containing tubes to dissipate heat from a contained liquid is well known. Generally, a series of tubes carry heated liquid and form a cooling system. The tubes have metal fins attached thereto which form heat dissipating means. The fins are generally made of aluminum or copper or the like. The common air conditioning unit or automobile radiator is a simple example of such a heat exchange unit.

The fins may be elongated, thin strips of aluminum. The width and length of the fins vary depending upon the number, diameter and configuration of the tubes. Generally, the fins may be force fit to the tubes or may be adhered thereto by solder or other means.

In order to provide anti-corrosion protection and ultra violet light resistance for the fins, it has been found advantageous to provide a coating on the surface of the fins. This coating also may produce a decorative effect.

One prior art method of providing such a coating on the fin is by spraying the coating on the fin after the assembly of the tube and the fin. This procedure is followed to prevent having an undesirable insulating film covering the tube/fin contact area which would reduce the operating efficiency of the unit.

Some of the difficulties with this procedure are the labor cost of applying the coating by spray or dipping, the equipment cost including spray tanks and ovens and the disposition of waste and other expensive steps.

In general in the assembled structure the fins are closely spaced and separated by the depth of the collar, usually about ⅛ inch apart, and so it is impossible to uniformly spray the coating on the finished unit since the atomized spray is travelling parallel to the fin surface.

Because of the difficulty in drying a non-uniformly applied coating, it is conventional to use a low solids, high volatile solvent based coating. The exposure of the paint line to fire and explosion and the extra cost of protection make this process undesirable.

Another method of coating the fin stock is to coat the full surface of both sides of the fin stock as it is unreeled from a large roll. This procedure is discussed in U.S. Pat. No. 4,588,025 which discloses the continuous application of a hydrophilic coating on both surfaces of an aluminum fin stock. This latter process does not solve the problem of the presence of a layer of the coating at the tube/fin contact area.

The present invention relates to a process which applies a protective coating in spaced stripes on the opposite surfaces of a sheet of fin stock as it is unwound from a larger roll. The fin stock is then cut in longitudinal strips so that for each strip there is an area along each edge which is coated and a central area which is uncoated. The uncoated central area is perforated and formed to receive one or more tubes to form a heat exchanger, while the outside edge areas act as heat dissipaters. The coating at the outside edge area also acts as a protective barrier against corrosion. The uncoated central area contacts the outside of the fluid-carrying tubes so that there is bare metal to metal contact.

It is therefore an object of the present invention to provide a novel heat exchanger which has a protective coating along the outer edge areas only.

It is another object of the present invention to provide a novel heat exchanger which will not have a coating layer between the fins and the tubes which carry the fluid.

It is still another object of the present invention to provide a novel heat exchanger in which the process of coating the fins of the heat exchanger after assembly is avoided.

It is yet another object of the present invention to provide a novel heat exchanger which can have the edge areas of the fins coated with a water-based coating by a simple and economical process.

Other objects and advantages of the present invention will occur to those skilled in the art from a consideration of the following description taken in conjunction with the accompanying drawing in which like numerals indicate like elements and in which.

Figure 1:
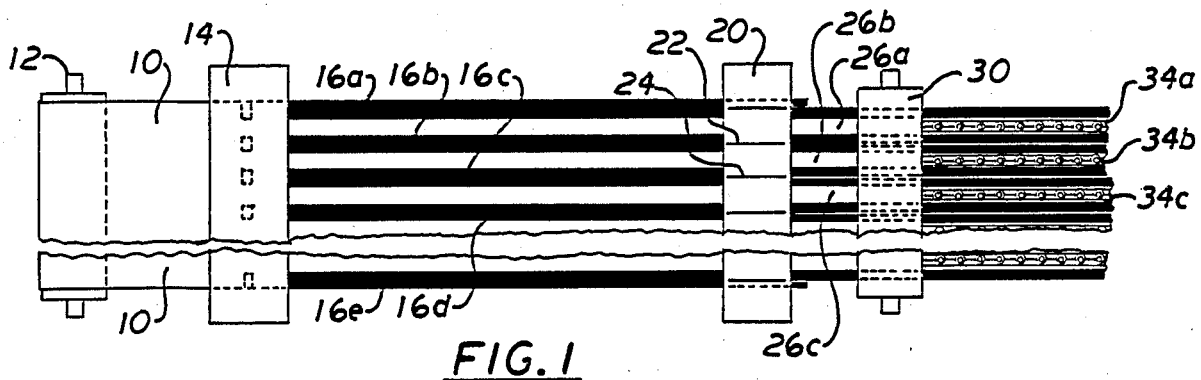
FIG. 1 is a schematic top view of an apparatus for making the fins of the present invention.

Referring now to FIG. 1, there is shown a schematic view of the apparatus for making the fins of the invention. Because the apparatus may be conventional in the art of coating, cutting and shaping aluminum foil, the details of the individual pieces of equipment are not shown.

A roll of aluminum fin stock 10 is mounted on an axis 12. Axis 12 is a part of a roll unwind system (not shown) which allows an elongated sheet of fin stock 10 to be unwound for further processing. The aluminum fin stock is aluminum having a thickness of 0.0045 inch, a width of 33.5 inches and an indeterminate length. Fin stock 10 is fed through a coating applicator 14 which may be a conventional rotogravure apparatus capable of applying a coating in stripes on both surfaces of fin stock 10. The fin stock 10 as it emerges from coating applicator 14 has stripes **16*a*–16*e* on both surfaces. In the example shown in FIG. 1, fin stock will form three fins 34*a*, 34*b* and 34*c*. The center stripes 16*b*, 16*c* and 16*d* are about ½" wide while the two outer stripes 16*a* and 16*e* are slightly wider to allow for trim. In practice fin stock 10** will produce 15 fins each with coated edge areas and a central uncoated area.

The fin stock 10 with the stripes **16*a*–16*e* are fed into a slitter 20 which has spaced knives or cutters 22 and 24. Cutters 22 and 24 are located so that they will cut the fin stock 10 along the central axes of stripes 16*b* and 16*c*. Thus, three separate fins 26*a*, 26*b* and 26*c* of about 1 inch in width are produced. The continuous fins 26*a*, 26*b* and 26*c* are fed into a stamping and forming press 30. Stamping and forming press 30 may be basically similar to the stamping and forming press shown and described in U.S. Pat. No. 2,994,123 of which Richard W. Kritzer is the inventor. The stamping and forming press 30** can be easily designed and assembled by a tool and die maker skilled in the aluminum forming art and need not be further described. A suitable stamping and forming press may be purchased from Burr Oak Tool and Die Co. of Sturgis, Mich.

The output of stamping and forming press 30 is separate strips of formed fins 34*a*, 34*b* and 34*c*.

An alternative process to form the fins may be to feed the fin stock 10 directly into a stamping and forming press of the type described prior to cutting the separate fins 34*a* into predetermined lengths and widths. This method has the advantage that the manufacturer has flexibility in changing widths and lengths to accommodate heat exchange reuqirments.

Figure 2:
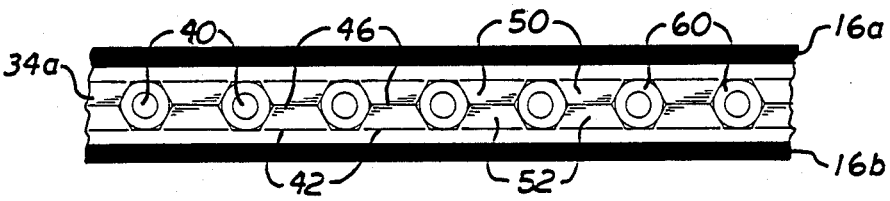
FIG. 2 is an enlarged top elevational view of the completed fin of the invention.

An enlarged view of a typical one of the fins 34*a* is shown in FIG. 2. Fin 34*a* has a series of spaced holes 40 through which fluid carrying tubes (see FIGS. 3 and 4) may be moved. Along each outer edge of fin 34*a* is a strip of coating 16*a* and 16*b* applied by coating applicator 14. The two stripes 16*a* and 16*b* extend inwardly of fin 34*a* to about the edge of holes 40. Between adjacent ones of holes 40 of fin 34*a* are areas 42 which are formed by bending the area between adjacent holes 40 into a centrally raised portion 46 and downwardly sloping areas 50 and 52. Circular flat areas 60 surround holes 40. This configuration is formed in fin 34*a* to impart a measure of stiffness in the otherwise limp fin. Obviously, other configurations can be made in the fin 34*a* to achieve such stiffness.

At the inner periphery of each hole 40 is formed a collar or outwardly expanded area 64. (See FIG. 3). The interior surface area of collar 64 is not coated since the central area of fin 34*a* from which collar 64 is formed has not been coated.

Figure 3:
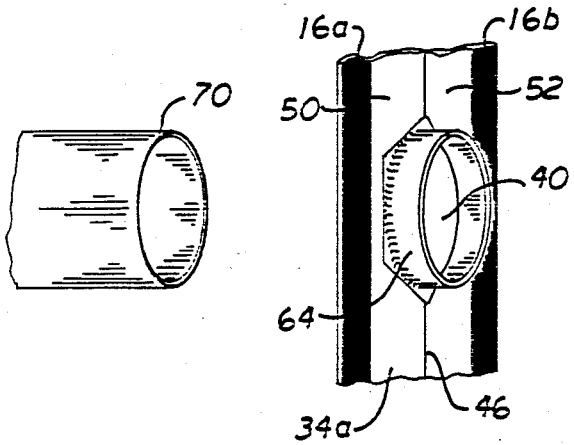
FIG. 3 is an enlarged perspective view of the combination of the tube and fin of the invention prior to final assembly.

As can be seen in FIG. 3, when tube 70 is pushed through hole 40 in fin 34*a*, the outer surface of tube 70 contacts the inner surface of fin 34*a* and makes direct metal-to-metal contact therewith with no coating in between the fin 34*a* and the tube 70.

Figure 4:
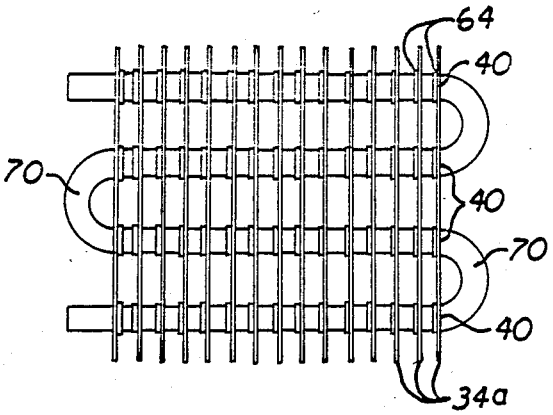
FIG. 4 shows a front schematic view of one embodiment of the assembled heat exchanger of the invention.

FIG. 4 shows an enlarged sectional view of a heat exchanger according to the present invention illustrating the arrangement between zig-zag tube 70 and a series of fins 34*a*. Tubes 70 fit through holes 40 in fin 34*a* and as shown in FIG. 3 are in contact with the collar of hole 40, there is a force fit between tube 70 and collar 64 of fin 34*a*.

A suitable high gloss coating for making the stripes on fin stock may be made according to the following formulation:

| | % by Weight |
|---|---|
| Acrylic resin emulsion | 68.41 |
| Wax emulsion | 6.96 |
| Carbon black dispersion | 15.12 |
| 2-butoxyethanol | 4.54 |
| Hexamethoxymethylmelamine | 2.27 |
| Acetylenic diol | 1.66 |
| Polysiloxane | 1.04 |
| | 100% |

If matte finish is desired the following formulation may be used:

| | % by Weight |
|---|---|
| Acrylic resin emulsion | 59.57 |

-continued

| | % by Weight |
|---|---|
| Hexamethoxymethylmelamine | 1.99 |
| 2-butoxyethanol | 3.96 |
| Acetylenic diol | 1.44 |
| Wax emulsion | 5.42 |
| Carbon black dispersion | 13.72 |
| Polysiloxane | 0.90 |
| | 100% |

It is obvious that outer coatings may be formulated which will fulfill the requirements of anti-corrosion and good U-V protection as well as efficient energy dissipation. The above formulations are given as being illustrative only. The ingredients are well known to those skilled in the art of coating formulations.

An equivalent alternative fin arrangement may be made wherein only one side of the fin is completely coated and the tube is inserted through the uncoated side of the fin so that metal-to-metal contact is maintained while at least one side of the fin is coated.

In summary, the present invention relates to a heat exchanger in which coated fins provide for radiation of heat. The fins have coatings along their outer edges but have non-coated central areas where the fins contact the fluid carrying tubes.

The invention is not to be understood as restricted to the details set forth since they may be modified within the scope of the appended claims without departing from the spirit and scope of the invention.

I claim:

1. A fin for connection to a fluid conducting tube comprising an elongated thin metallic strip having on at least one side thereof an uncoated, longitudinal central area and stripes of a coating material along outer edge areas thereof, said central area having a series of spaced holes, each of said holes having a collar extending outwardly from the plane of said fin and surrounding said hole, and each of said stripes of coating material extending from the outer edge of said fin toward an area adjacent to each of said collars.

2. A fin as recited in claim 1 in which said stripes are coated on both sides of said fin.

3. A fin as recited in claim 1 in which said fin is made of a metal selected from the group consisting of aluminum and copper.

4. A fin as recited in claim 3 in which said central area has a flat area surrounding each of said holes, said flat areas lying in the main plane of said fin.

5. A fin as recited in claim 1 in which said central area has reinforcing areas between adjacent pairs of said holes, said reinforcing areas comprising a raised portion and sloping areas leading to the inner edges of said stripes of coating material.

6. A heat exchanger comprising a series of parallelly spaced fins and a plurality of fluid carrying tubes penetrating said series of parallelly spaced fins, each of said fins having an uncoated central area and stripes of a coating material along outer edge areas thereof, said central areas of said fins having spaced holes, said holes having surrounding uncoated collars, and said tubes being in assembled relation with each of said tubes passing through said holes in said parallelly spaced fins and being in contact with said uncoated collars surrounding said holes.

* * * * *